US006837799B2

(12) United States Patent
Cameron et al.

(10) Patent No.: US 6,837,799 B2
(45) Date of Patent: Jan. 4, 2005

(54) PUTTER WITH ALIGNMENT SYSTEM

(75) Inventors: Donald T. Cameron, Carlsbad, CA (US); William B. Lacy, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/676,818

(22) Filed: Oct. 3, 2003

(65) Prior Publication Data

US 2004/0072631 A1 Apr. 15, 2004

Related U.S. Application Data

(62) Division of application No. 10/136,950, filed on May 2, 2002, now Pat. No. 6,663,496.

(51) Int. Cl.[7] ..... A63B 69/36

(52) U.S. Cl. ..... 473/221; 473/222; 473/223; 473/224; 473/242

(58) Field of Search ..... 473/220, 221, 473/222, 223, 224, 225, 241, 242, 234, 236

(56) References Cited

U.S. PATENT DOCUMENTS

| | | | | | |
|---|---|---|---|---|---|
| 1,046,343 | A | | 12/1912 | Smith | |
| 3,019,022 | A | * | 1/1962 | Ehmke | 473/240 |
| 3,194,563 | A | * | 7/1965 | Mackniesh | 473/222 |
| D209,149 | S | | 11/1967 | Sowers | |
| 3,802,709 | A | * | 4/1974 | Elkins, Jr. | 473/222 |
| 3,954,265 | A | | 5/1976 | Taylor | |
| 3,966,210 | A | * | 6/1976 | Rozmus | 473/341 |
| D240,751 | S | | 7/1976 | Taylor | |
| 4,077,632 | A | | 3/1978 | Taylor | |
| 4,306,722 | A | * | 12/1981 | Rusnak | 473/221 |
| 4,341,384 | A | * | 7/1982 | Thackrey | 473/222 |
| 4,839,968 | A | * | 6/1989 | Logsdon | 33/286 |
| 4,997,189 | A | * | 3/1991 | Perkins | 473/221 |
| D325,950 | S | | 5/1992 | Duran | |
| 5,165,691 | A | | 11/1992 | Cook | |
| 5,169,150 | A | * | 12/1992 | Tindale | 473/220 |
| D333,331 | S | | 2/1993 | Evans | |
| 5,193,812 | A | | 3/1993 | Hendricksen | |
| 5,207,429 | A | * | 5/1993 | Walmsley et al. | 473/220 |
| 5,213,331 | A | | 5/1993 | Avanzini | |
| D347,253 | S | | 5/1994 | Cook | |
| 5,330,188 | A | | 7/1994 | Reimers | |
| 5,435,562 | A | | 7/1995 | Stock et al. | |
| 5,452,897 | A | * | 9/1995 | Mick | 473/409 |
| 5,464,215 | A | * | 11/1995 | Koehler | 473/341 |

(List continued on next page.)

*Primary Examiner*—Sebastiano Passeniti
(74) *Attorney, Agent, or Firm*—William B. Lacy

(57) ABSTRACT

A method of aligning a putter, including the steps of providing a putter having a head, a heel, a toe, and a planar striking face including a removable reflecting surface for receiving and reflecting incident light; providing a light source separate from the putter head; directing light from the light source towards the reflecting surface such that the reflective surface is illuminated with and reflects a portion of the light; and detecting the reflected light with a reference device.

13 Claims, 4 Drawing Sheets

U.S. PATENT DOCUMENTS 5,464,221 A 11/1995 Carney
5,501,463 A * 3/1996 Gobush et al. ..... 473/199
5,533,728 A 7/1996 Pehoski
D372,752 S 8/1996 Raudman
5,611,739 A 3/1997 Carney
5,615,884 A 4/1997 Modglin
5,676,603 A 10/1997 Miller
5,707,296 A 1/1998 Hodgson et al.
5,716,286 A 2/1998 Swan
5,720,668 A 2/1998 Brett
5,725,440 A * 3/1998 Finney ..... 473/220
5,762,564 A 6/1998 Schang
D404,450 S 1/1999 Weeks
5,873,789 A * 2/1999 Torriano ..... 473/220
5,890,977 A 4/1999 Taylor
5,924,934 A 7/1999 Hamilton
D416,964 S 11/1999 Steele
5,984,800 A 11/1999 Uebelhor
6,004,230 A * 12/1999 Hooker ..... 473/409
6,062,986 A 5/2000 Kaise
6,089,988 A 7/2000 Winslow
D434,094 S 11/2000 Miyashita
6,146,285 A 11/2000 Winslow
6,200,227 B1 3/2001 Sery
6,231,458 B1 5/2001 Cameron et al.
6,261,190 B1 7/2001 Ashcroft
6,371,864 B1 * 4/2002 Norwood ..... 473/220
6,458,038 B1 * 10/2002 Lin ..... 473/220

* cited by examiner

PUTTER WITH ALIGNMENT SYSTEM

CROSS-REFERENCE TO RELATED APPLICATIONS

This application is a divisional of U.S. application Ser. No. 10/136,950, filed May 2, 2002, now U.S. Pat. No. 6,663,496.

FIELD OF THE INVENTION

The present invention relates to golf clubs and, more particularly, to a putter that has an alignment system for aiding and improving a player's putting stroke.

BACKGROUND OF THE INVENTION

One of the most difficult strokes for a golfer to master and one that is equally difficult to teach, is a good, squarely-aligned, repetitive putting stroke. Recreational players can lose valuable strokes, that would otherwise significantly improve their scores, by taking 3 and 4 putts per green. Even professional players are greatly affected by their ability (or lack thereof) to putt. Good or even proficient putting may be the difference between a professional attaining or retaining their tour privileges, making or missing a cut in a tournament, or even winning or losing a tournament.

One way in which golfers' can improve their putting stroke is to use an alignment system. A variety of patents have issued that describe putter alignment methods, including U.S. Pat. Nos. 5,165,691; 5,169,150; 5,193,812; 5,207,429; 5,213,331; 5,330,188; and 5,388,832. Most of these alignment methods involve reference lines, lighted guides, marked training mats, or some combination thereof.

While these various methods have their advantages and disadvantages, their still remains a need for a putter and an alignment method that, when coupled together, provide a golfer with a removable (to keep the putter within all United States Golf Association rules and regulations), yet substantially error-free way of monitoring and improving their putting stroke. The present invention provides such a putter and alignment method, combining the benefits of a collimated light source, such as a laser, and physical markings on the putter head, to refine and improve a golfer's putting stroke.

SUMMARY OF THE INVENTION

The present invention is directed to a putter, comprising a head comprising an offset hosel; a heel; a toe; and a planar striking face; wherein the head comprises a first reference line is spaced from and parallel to said planar striking face; and a ladder comprised of a plurality of second reference lines, wherein the ladder is located substantially between the hosel and the heel and the second reference lines are perpendicular to the striking face.

Preferably, the head further comprises a top surface and a back surface. The first reference line and the ladder are typically positioned on the top surface and the ladder comprises less than about 10 second reference lines, preferably less than about 5 second reference lines, and most preferably, between about 2 and about 5 second reference lines.

The first reference line is substantially located between the heel and the hosel. The planar striking face may also include an insert, which can include a vibration dampener, the insert and vibration dampener being of different materials. Preferably, the insert is of a material that is different that the rest of the club head. Ideally, the insert includes a copper alloy.

The present invention is also directed to a method of aligning a putter, comprising the steps of providing a putter as described in claim 1 to a golfer; placing the putter in the golfer's neutral putting position; identifying the location of the hosel relative to the plurality of second reference lines; recording to memory the location of the hosel; and making a putting stroke, wherein the location of the hosel relative to the second reference lines remains constant throughout the entire swing.

The present invention is also directed to a putter, comprising a hollow grip comprising a first end having a first aperture, a second end comprising a second aperture and a collimated light source; a hollow shaft having a proximal end and a distal end; and a head comprising an offset hosel having a third aperture; a heel; a toe; and a planar striking face; wherein the first end of the grip is attached to the proximal end of the shaft and the distal end of the shaft is connected to the hosel, such that light emanating from the collimated light source is directed thought the second aperture.

The collimated light source can be a laser. Preferably, the second aperture has a diameter sufficient to receive the collimated light source, the light source having an outside diameter greater than the diameter of the second aperture. Ideally, the collimated light source is removably attached to the grip.

The present invention is also directed to a method of aligning a putter, comprising the steps of providing a putter comprising a head comprising an offset hosel; a heel; a toe; and a planar striking face comprising a reflecting surface; providing a focused, collimated light source; orienting the light source perpendicular to the reflecting surface and directing the light source such that the reflective surface is illuminated with light; monitoring the reflected light on a reference device. The collimated light source may be a laser. The reflecting surface may be a mirrored surface.

The present invention is further directed to a method of aligning a putter, comprising the steps of providing a putter comprising a head comprising an offset hosel having a first aperture; a heel; a toe; and a planar striking face, the striking face further comprising a semi-transmitting member; a hollow grip comprising a first end and a second end comprising a collimated light source; and a hollow shaft having a proximal end and a distal end; wherein the first end of the grip is attached to the proximal end of the shaft and the distal end of the shaft is connected to the hosel, such that light emanating from the collimated light source is directed thought the first aperture and strikes the semi-transmitting, polarized member creating a first light beam co-linear to the shaft and second light beam directed substantially perpendicular to the striking face towards a reference device; monitoring the first light beam; and monitoring the second light beam on the reference device.

BRIEF DESCRIPTION OF THE DRAWINGS

FIG. 5 is a side view of the putter and the beam splitter reflecting/pass-through.

DETAILED DESCRIPTION OF THE INVENTION

Figure 1:
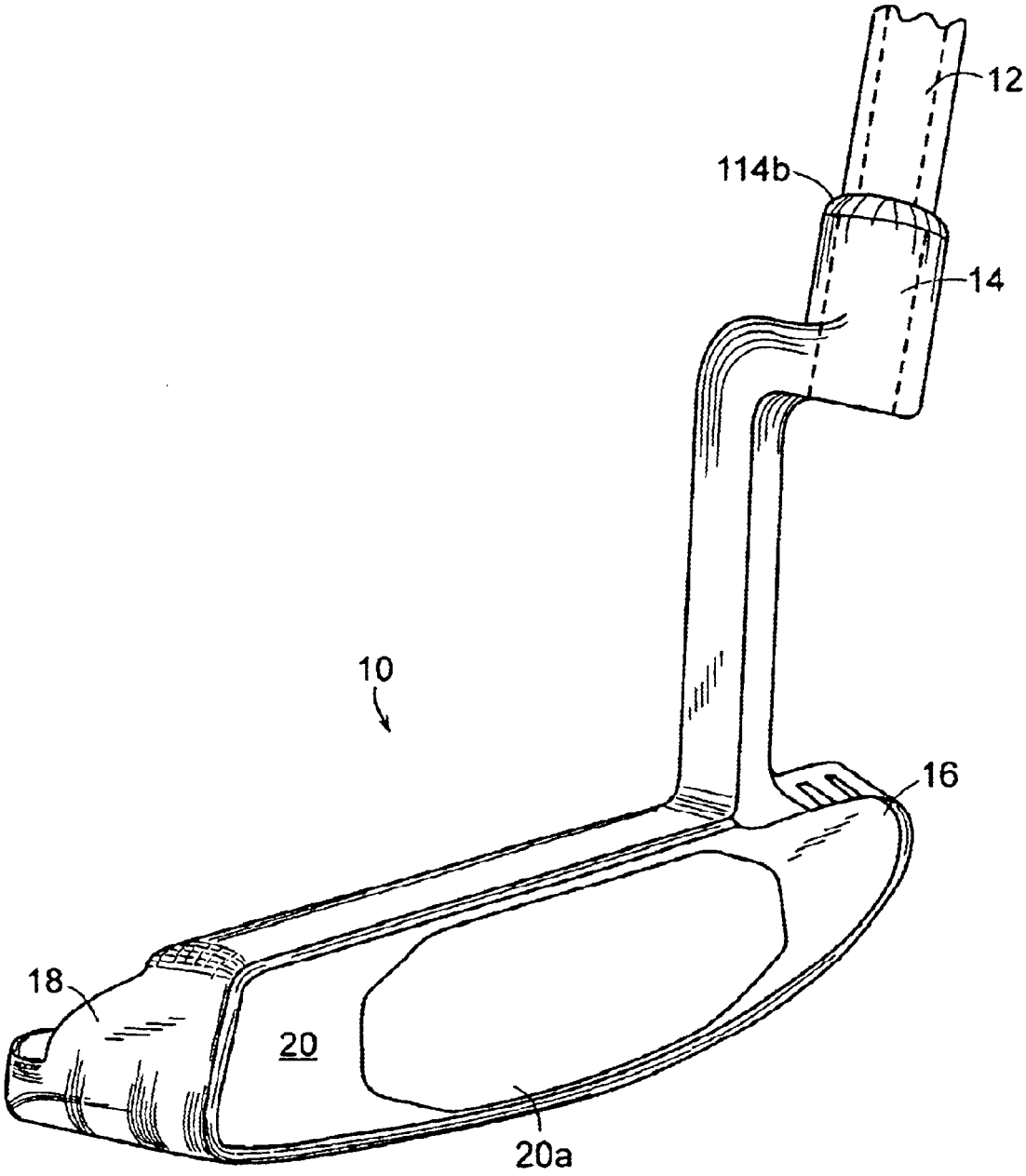
FIG. 1 is a perspective view of the putter and alignment system of the present invention.
Figure 2:
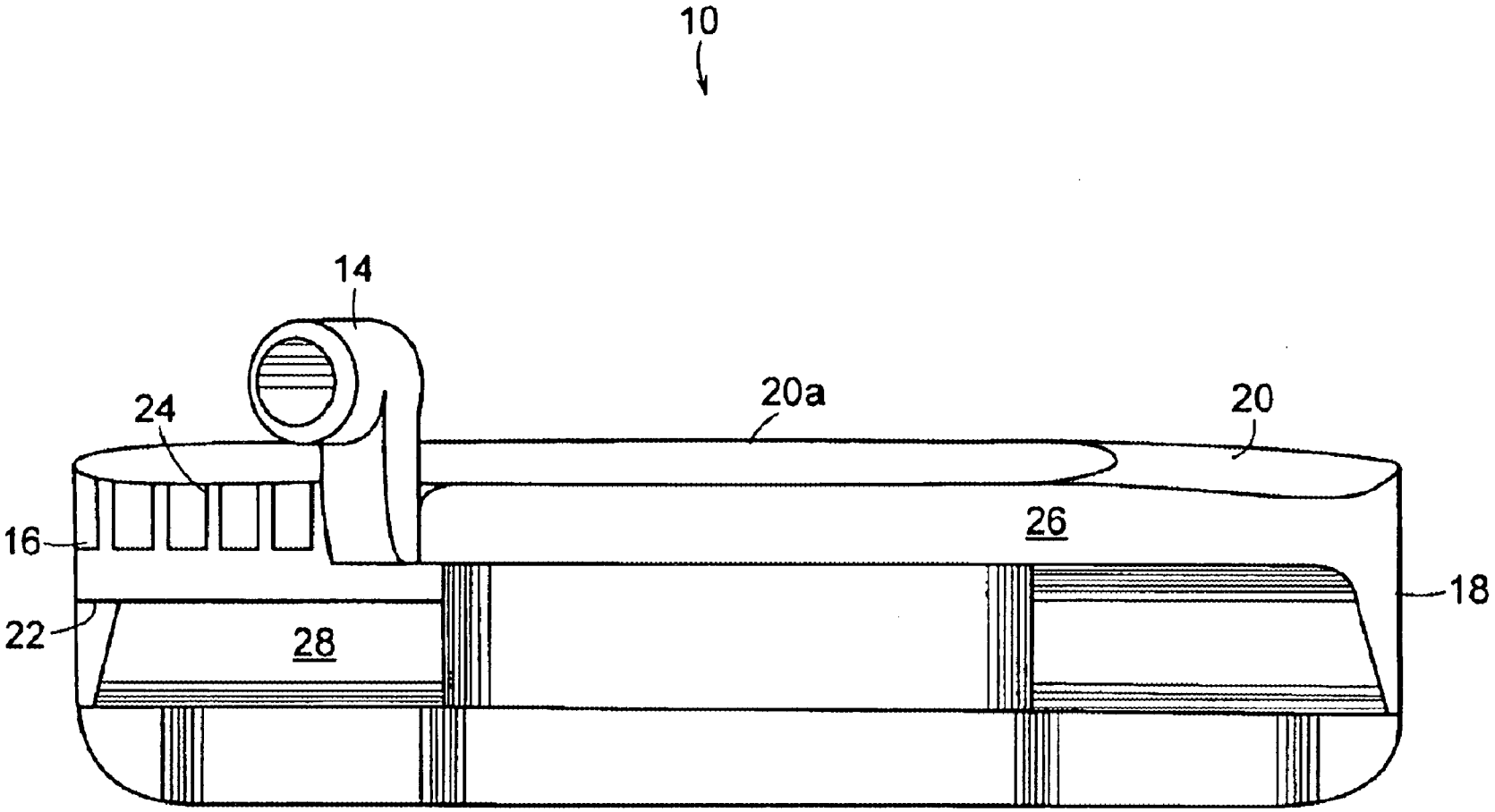
FIG. 2 is a top view of the putter and alignment system of the present invention.

According to the present invention and referring to FIGS. 1 and 2, a putter head 10, typically attached to a shaft 12 (only partially shown), comprises an offset hosel 14 for receiving the shaft, a heel portion 16 at the hosel end of the putter head, a toe portion 18 opposite the heel portion 16, and a striking face 20. Extending between the heel portion 16 and the toe portion 18 is the strike face 20, which is the surface that contacts the golf ball (not shown) upon impact between the putter head 10 and the ball. The strike face 20 generally includes a "sweet spot," or the center of gravity in the toe to heel direction. The strike face 20 can be comprised of the same material as the putter head or may include an insert 20*a*, such as that disclosed in U.S. Pat. No. 6,231,458 ("the '458 patent"), which is incorporated herein, in its entirety, by express reference thereto. If an insert 20*a* is present, it preferably comprises a soft material, such as an elastomeric material or a tellurium copper alloy. A vibration dampening means, such as an elastomeric material that is deformable may also be used with the optional insert, as set forth in the '458 patent. In the preferred embodiment, the elastomeric material is a silicone material, Stock No. GE281, available from General Electric Company in Waterford, N.Y.

The strike face 20 has a loft angle, which may be any angle, but is preferably less than about 10 degrees, more preferably, between about 2 degrees and about 7 degrees, and most preferably, between about 3 degrees and about 5 degrees. Preferably, the loft of the strike face 20 is set so that the putter has 4 degrees of loft at impact for the individual golfer using the putter.

Referring to FIG. 2, the putter head further contains an alignment system for a golfer that comprises at least one first reference line 22 and a plurality of second reference lines 24. The at least one first reference 22 line is spaced apart from and parallel to the striking face 20, which is substantially planar, and runs along the top surface 26 of the putter head 10, extending from the heel 16 to a location generally where the hosel 14 attaches to the putter head 10. More preferably, the first reference line 22 extends from the heel 16 to the point where the hosel 14 abuts the back surface 28 of the front striking face 20. The plurality of second reference lines 24 (the "ladder") are also located on the top surface 26 of the putter head 10, substantially between the hosel 14 and the heel 16. The plurality of second reference lines 24 are oriented perpendicular to the striking face and the first reference line 22, and each individual line of the ladder 24 is spaced from each other such that the spacing provides a golfer with a visual reference points when observed from above. Preferably, the lines are less than about 0.75 inches apart, more preferably, less than about 0.5 inches apart, and most preferably, less than about 0.25 inches apart.

The hosel 14 can form an angle relative to the top surface 26 of the putter head 10 to provide all or part of the lie angle. Generally, putter hosels extend from the putter perpendicularly and the shaft receiving boss is angled to form the lie angle. However, in the present invention, the hosel itself can be angled. Preferably, the hosel 14 forms and angle of about 10° to about 30° with the top surface 26 of the putter head 10 and, more preferably, forms and angle of about 15° to about 25° with the top surface 26 of the putter head 10.

In a method of aligning the putter head, a golfer first holds the putter in the manner they typically would while addressing a golf ball prior to making a putting stroke. The hosel 14 of the putter head 10 will obscure some, all, or none of the plurality of lines comprising the ladder 24 depending on the lie angle that is natural to the golfer. By identifying what portion of the ladder 24 is obscured, and where the obscured portion is located relative to the heel portion 16, the golfer can determine whether the putter head 10 lie angle is oriented in a flat, upright, or neutral position. Additionally, the golf can determine the effective loft of their putting stroke by observing the position of the back edge 28 of the hosel 14 relative to the first reference line 22. If the back edge 28 of the hosel 14 is leading the first reference line 22, the putter is oriented in a closed face orientation. If the back edge 28 of the hosel 14 is abutting the first reference line 22, the putter loft angle is in a neutral position. If the back edge 28 of the hosel 14 is obscuring or trailing the first reference line 22, the putter loft is oriented in an open position.

In a further embodiment of the method of alignment, the golfer can use the positions of the hosel 16 relative to both the first reference line 22 and the ladder 24 to keep the putter head 10 oriented in the same location throughout the entire putting stroke (i.e., the identical number of lines in the ladder 24 are obstructed from view during the entire putting stroke). Not only can the golfer ensure consistent head orientation but they can use the alignment method as a training aid to correct and adjust poor or incorrect putter orientation.

Figure 3A:
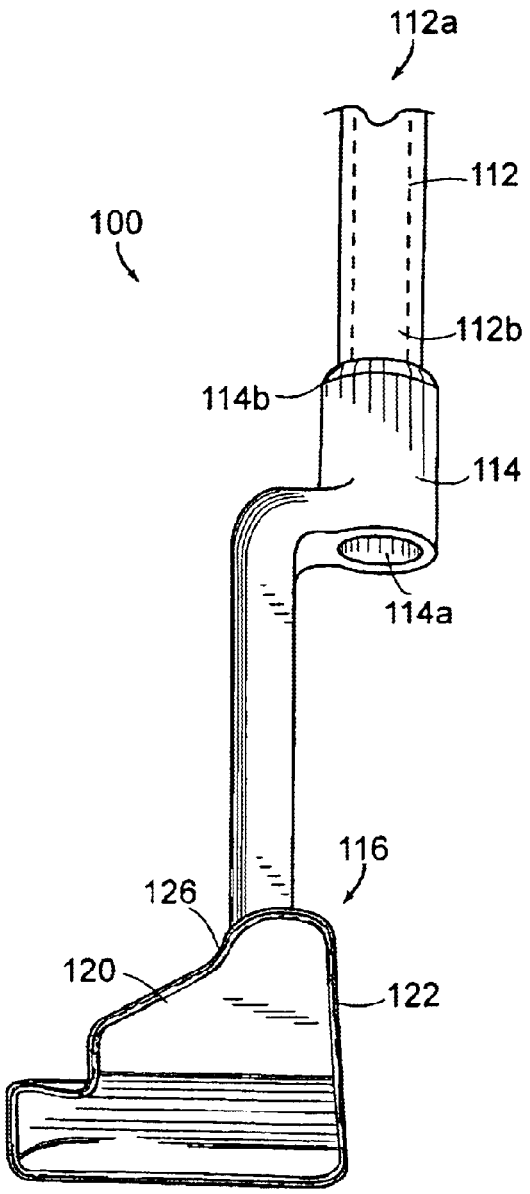
FIG. 3*a* is a side view of the grip end of the putter of the present invention.
Figure 3B:
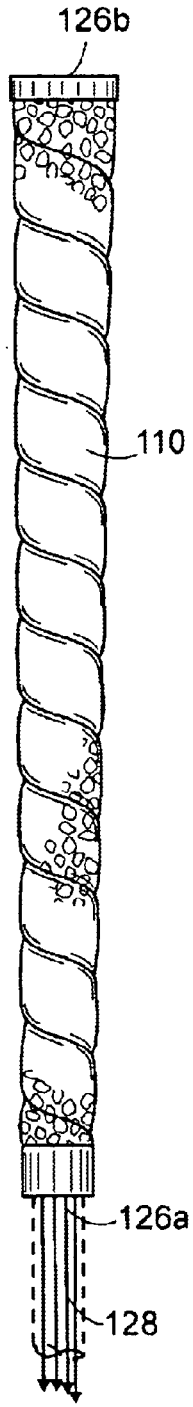
FIG. 3 is an end view of the putter and alignment system of the present invention.

In another embodiment of the present invention, referring to FIGS. 3 and 3*a*, a putter 100 comprises a grip 110 attached to distal end 112*a* of a hollow shaft 112 and an offset hosel 114 for receiving the proximal end 112*b* of the shaft. The hosel 114 generally contains a shaft boss 114*b* for receiving the shaft. The hosel 114 further comprises a hosel aperture 114*a* into which the hollow shaft 112 is received. The putter 100 further comprises a putter head 116 comprising a heel portion 118, a toe portion 120 opposite the heel portion 118, and a striking face 122. The striking face 122 comprises a front face 124 and a back face 126. The front surface of the strike face 124 is the surface that contacts the golf ball (not shown) upon impact between the putter head 116 and the ball.

The grip 110 has a first and second aperture (126*a* and 126*b*), the first aperture 126*a* for receiving the distal end 112*a* of the shaft 112, and the second aperture 126*b* for receiving a collimated light source 128, such as that emitted from a laser pointer, typically a solid state laser of minimal power (typically less than about 3 mW). The second aperture 126*b* should have a diameter sufficiently sized to receive the collimated source 128 while firmly retaining it in the aperture. The apertures can be any diameter, however, preferred diameters are less than about 0.75 inches, more preferably less than about 0.5 inches, and most preferably less than about 0.3 inches.

Further, the diameter of both the second aperture 126*b* and the collimated light source should be smaller than the internal diameter of the hollow shaft 112 such that the light source 128 will fit inside and co-axial with the hollow shaft 112. The collimated source 128 is positioned substantially co-linear with the axis of the hollow shaft 112 such that the light may emerge from the proximal end of the shaft 112*a* and through the hosel aperture 114*a*. The collimated light beam will be visible on the ground in front of the striking face 122, allowing a golfer to follow the track of the putting stroke while actually making the stroke. There is, therefore, a method of training a golfer to follow a proper putting stroke swing plane afforded by the above-described light-source-containing putter.

Figure 4:
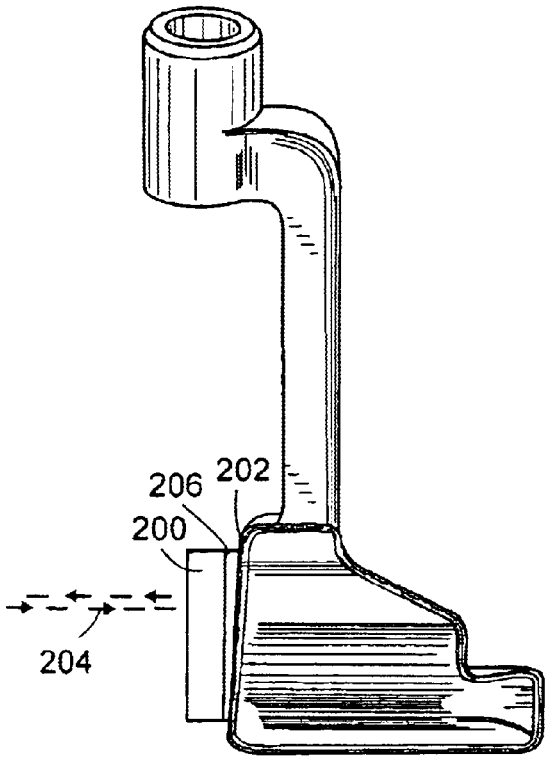
FIG. 4 is side view of the putter and the reflecting surface.

Referring to FIG. 4, another embodiment of the present invention includes a method for aligning a putter face prior to making a putter stroke as a training aid to ensure squareness of the putter with respect to the putting line. A collimated light source, such as that emitted from a laser (i.e., a solid state laser, laser pointer), is oriented perpendicular to the striking face of a putter and is directed at the putter head. The putter head comprises a reflective surface 200 attached to the striking face 202 for reflecting the laser beam 204 back towards an indexed reference device, such as an opaque surface, such as a ruler or paper, a grid, such as graph paper, or a photo-detector, such as a charge-coupled device ("CCD"). The reflective surface can be any reflective surface, but is preferably a mirror or highly-polished fused silica or glass. A spacer or shim may also be used to orient the reflecting surface in the proper angle for return of the collimated light source to the reference device.

As a golfer address a golf ball prior to making a putting stroke, the laser beam is directed back at the reference device. The location of the reflected beam of light on the reference device aids the golfer in determining the orientation of the putter face prior to making the putting stroke. For example, if the putter face is held in an "open" orientation, the laser beam spot will be reflected to the right of center on the reference device. Conversely, of the putter face is held in a closed orientation, the laser beam spot will be reflected to the left of center on the reference device. Of course, if the putter face is square, the laser beam spot will be reflected directly to the center of the reference device.

Figure 5:
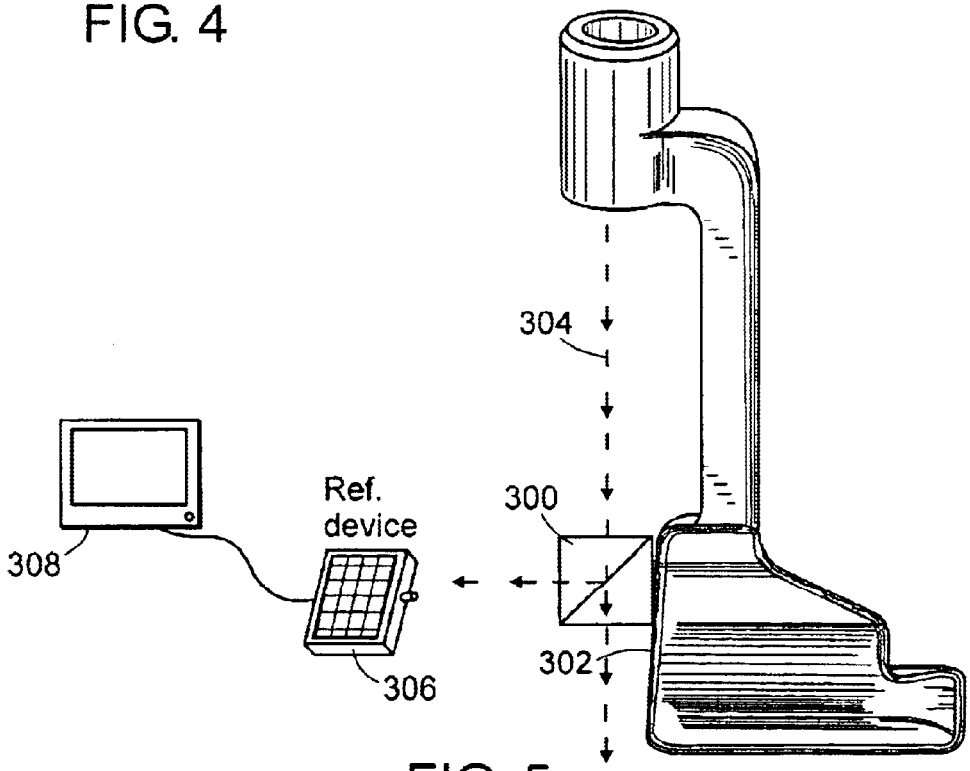

Referring to FIG. 5, in an alternative embodiment of the present invention, a beam splitter (or other partial light reflecting, refracting, or transmitting device) 300 is attached to the striking face 302 of the putter. The beam emanating from the collimated light source 304 located in the grip of the putter, such as that emitted from a laser pointer, is allowed to strike the beam splitter 300. The beam splitter 300 allows part of the laser beam to pass directly through it such that it still strikes the ground (as described above), allowing a golfer to align and train their putting stroke plane. The remaining light energy of the laser beam, typically about 50%, is directed in a direction perpendicular to the striking face 302 for use in directional alignment of the strike face 302 itself. The redirected part of the laser beam hits the reference device, allowing a golfer to determine the orientation of the striking face of the putter prior to initiating a putting stroke.

Suitable beam splitters include beam splitter cubes and right angle prisms, such as Model Nos. 46216, 46219, 46222, 46225, and 46240 (beam splitter cubes) and Model Nos. 46060, 46070, 46165, and 46166 (right angle prisms), commercially available from Oriel Instruments of Stratford, Conn. Beam splitter cubes split a laser beam into two orthogonal beams. These beam splitters do not displace the beam and are typically optimized for a specific wavelength of laser light. Beam splitter cubes are generally made from two borosilicate glass right angled prisms cemented together at the hypotenuse. The hypotenuse of one prism is coated with a beam splitter coating prior to cementing. Additionally, a high efficiency anti-reflection coating is applied to the entrance and exit faces. Right angle prisms turn a laser beam 90° through total internal reflection off the hypotenuse. Reflectance is very high, typically 99%, especially when an anti-reflection coating is used.

The reference device can be anything that gives the golfer "feedback" regarding their putting stroke and can include, without limitation, any flat surface, a grid, graph paper, or any photosensitive-array detector, such as a photomultiplier tube, an avalanche photodiode, or a CCD. If the reference device is a photosensitive-array, the signal generated by such may be transferred to an output device, such as a PC, monitor, or an oscilloscope so that the golfer can visually "see" their alignment and/or store the data from such for future use, perhaps for downloading to a personal data assistant (i.e., a Palm Pilot®).

Another embodiment of the present invention combines the reference device above with a similar reference device in the floor (or a holding device, such as a mat) below the golfer. In combination with the collimated light source and a beam splitter, a golfer may not only gain valuable information about his alignment and putting swing path, he may obtain both simultaneously. The visual and recorded data from such a training session may be stored and/or correlated for analysis by the golfer or a golf coach, as well as being retained for comparison purposes at a later training session.

As used herein, the term "about," used in connection with one or more numbers or numerical ranges, should be understood to refer to all such numbers, including all numbers in a range.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method of aligning a putter, comprising the steps of:

providing a putter having a head, a heel, a toe, a top surface, and a planar striking face comprising a removable reflecting surface for receiving and reflecting incident light, the top surface comprising at least one first reference line oriented substantially parallel to the striking face and a plurality of second reference lines oriented substantially perpendicular to the striking face;

providing a light source separate from the putter head;

directing light from the light source towards the reflecting surface such that the reflective surface is illuminated with and reflects a portion of the light towards a reference device;

detecting the reflected light with a reference device, wherein the reference device is a photosensitive array and the reflected light incident upon the photosensitive array generates a signal capable of being transferred to an output device visible to a golfer;

determining the location of the reflected beam on the reference device relative to a central point prior to the golfer making a putting stroke;

correcting the orientation of the putter so that the reflected beam is directed at the center of the reference device; and using the reference lines to provide a visual reference point to the golfer indicative of putter orientation.

2. The method of claim 1, wherein the light source is a laser.

3. The method of claim 1, wherein the reflecting surface is a mirrored surface, highly-polished fused silica, highly-polished glass, or a beam splitter.

4. The method of claim 1, wherein the photosensitive array comprises a photomultiplier tube, an avalanche photodiode, or a charge-coupled device.

5. The method of claim 1, wherein the light is collimated, focused, or both.

6. The method of claim 1, wherein the planar striking face has a loft of between about 2 degrees and about 7 degrees.

7. The method of claim 6, wherein the loft is about 4 degrees.

8. The method of claim 1, wherein a spacer or a shim is disposed between the planar striking face and the reflecting surface.

9. The method of claim 1, wherein the reflecting surface is a beam splitter oriented such that a first fraction of the light is reflected towards the reference device and a second fraction of the light is redirected perpendicular the incident light.

10. The method of claim 9, wherein the redirected light strikes the ground below the striking face such that the golfer may align a putting stroke path.

11. The method of claim 1, wherein the output device comprises a personal computer, a monitor, an oscilloscope, or a personal data assistant.

12. The method of claim 1, further comprising the step of;

providing a second reference device located below the putter head.

13. A method of aligning a putter, comprising the steps of:

providing a putter having a head, a heel, a toe, a top surface, and a planar striking face having a loft of about 4 degrees and comprising a reflecting surface for receiving and reflecting incident light, the reflecting surface being oriented vertically by a shim or a spacer, and the top surface comprising at least one first reference line oriented substantially parallel to the striking face and a plurality of second reference lines oriented substantially perpendicular to the striking face;

providing a light source separate from the putter head;

directing light from the light source towards the reflecting surface such that the reflective surface is illuminated with and reflects a portion of the light;

detecting the reflected light with a reference device;

comparing the reflected light to a central location on the reference device so that a golfer may determine the orientation of the putter head; and using the reference lines to provide a visual reference point to the golfer indicative of putter orientation.

* * * * *